US006022089A

United States Patent [19]

Mori

[11] Patent Number: 6,022,089

[45] Date of Patent: Feb. 8, 2000

[54] IMAGE FORMATION APPARATUS

[76] Inventor: Hiroki Mori, 2795-17, 6-chome, Higashi-sayamagaoka, Tokorozawa-City, Saitama-Pref., Japan

[21] Appl. No.: 08/630,174

[22] Filed: Apr. 10, 1996

[30] Foreign Application Priority Data

Apr. 18, 1995 [JP] Japan ..... PCT/JP95/00759

[51] Int. Cl.[7] ..... B41J 3/00; B41J 2/14

[52] U.S. Cl. ..... 347/2; 347/51

[58] Field of Search ..... 347/2, 42, 51, 347/85

[56] References Cited

U.S. PATENT DOCUMENTS 4,652,722 3/1987 Stone et al. ..... 219/121
5,021,808 6/1991 Kohyama ..... 347/66
5,568,170 10/1996 Hirano et al. ..... 347/51

*Primary Examiner*—Peter S. Wong
*Assistant Examiner*—Gregory J. Toatley, Jr.

[57] ABSTRACT

A high-speed image formation apparatus with a simple construction, which is economical and light in weight, and can save space and energy. In the Figure, the apparatus comprises laser scanner means (11) for scanning an object and can save space and energy. In the Figure, the apparatus comprises laser scanner means (11) for scanning an object with a laser beam emitted from a laser beam source; ink jet means (13) for holding a printing material such as ink in a region adjacent to the surface of a printing medium(14) and along a direction transversely crossing the conveying direction of the printing medium and jetting the printing material at the portion, which is irradiated by the laser beam scanned along this region, towards the surface of the printing medium; conveyor means(12) for conveying the printing medium; and printing control means(10) for controlling the laser scanner means(11) and the conveyor means.

8 Claims, 10 Drawing Sheets

IMAGE FORMATION APPARATUS

FIELD OF THE INVENTION

This invention relates to Image Formation Apparatus. It is an optical image formation device which prints on the medium by scanning of laser beam.

BACKGROUND OF THE INVENTION

Optical image formation devices which use scanning of laser beam have previously been proposed as follows:

First, laser beam is irradiated according to printing data against photo sensitive drum electrified to the same polarity to toner. The part where laser beam is irradiated becomes conductive status so the electrical charge of that part is removed then a latent image is made. So by putting toner on it, a toner image will be formed. Then the toner image is transcribed on a paper and it is fixed.

As stated above, it is requested in the conventional printer to install several complicated mechanism like photo sensitive drum, electrification of this drum, electrification system of toner, transcription, fixation, etc. Because of these mechanism, it contains problems that the whole system becomes big size and the price becomes high.

Also in the conventional laser printer, it is necessary to have complicated process like exposure to make latent image, visualization of latent image, transcription to a paper, fixation, etc. Because of this, it contains problem that total printing process becomes complicated and takes much time.

SUMMARY OF THE INVENTION

This invention aims an image formation apparatus that makes high speed printing with simple composition, low price, light weight, and achieving conserve space and energy.

To solve the above-mentioned problems, the inventions are made as follows:

Embodiment No.1

As shown in FIG. 1, it contains a laser beam scanning means(11) which scan the laser beam emitted from a laser beam source; ink jet means(13) which hold a printing material such as ink in a region adjacent to the surface of a printing medium(14) and along a direction transversely crossing the conveying direction of the printing medium, and jetting the printing material at the portion, which is irradiated by the laser beam scanned along this region, towards the surface of the printing medium; conveyor means (12) for conveying the printing medium; and printing control means(15) for controlling the laser scanner means(11) and the conveyor means(12).

For laser beam source, in addition to a semiconductor laser, devices which switch on and off by light switch or change transparent light volume by using liquid crystal shutter or similar unit can also be used. Or the other laser oscillators are also acceptable.

A "direction transversely crossing" usually means the direction crossing at right angle to the conveying direction of printing medium but it is not always limited in the right angle.

In order to "jetting the printing material at the portion which is irradiated by the laser beam scanned along this region" against the printing medium, it is necessary to hold the ink in a porous material which has lots of minute holes. When the laser beam is irradiated on the porous material which holds the ink, the ink in the irradiated portion will expand or evaporate by the laser energy. As a result, the ink is gushed from the porous material and jet to the printing medium.

The operation of the first invention will be done as follows:

When the order of printing is received, the printing control means(15) controls in sequence the presence or strength of the laser beam source of the laser beam scanning means(11), then the laser beam issued synchronizing with the instruction are scanned by the laser beam scanning means(11), irradiated to the ink jet means(13).

The ink maintained near to printing medium along the direction transversely crossing the conveying direction, is jet to the printing medium one by one when the laser beam is irradiated. At the same time, synchronizing with the scan of laser beam, the conveying means(12) transports the printing medium by the designated distance.

As explained above, because the first invention has simple composition of installing a laser beam scanning means and ink jet means which jet ink by irradiating laser beam, it contributes to size miniaturization, weight lightening, lower costing of the printer and diminish running cost.

It can achieve to speed up the printing because it is not necessary to move a printing head unlike conventional ink jet printers. It also contributes to longevity of the device as it does not require mechanical structures.

Embodiment No.2

The second invention is shown in FIG. 2. It has a laser beam scanning means(11), two or more ink jet means ($\mathbf{23}_1$~$\mathbf{23}_n$), selective movement means(16), conveyor means (12) and multicolor tone printing control means(20).

The plural ink jet means($\mathbf{23}_1$~$\mathbf{23}_n$) which hold ink or any printing material of different or same color tone are adjacent to the surface of a printing medium(14) and are along a direction transversely crossing the conveying direction of the printing medium(14), and jet the printing material at the portion which is irradiated by the laser beam scanned by laser beam scanning means(11) along this region, toward the surface of the printing medium(14).

The selective movement means(16) move the selected ink jet means which is selected from the plural ink jet means ($\mathbf{23}_1$~$\mathbf{23}_n$) to the position where the laser beam irradiated by the laser beam scanning means(11).

The conveyor means(12) transport the printing medium (14). The multicolor tone printing control means(20) control the laser beam scanning means(11), the selective movement means(16) and the conveyor means(12) according to given printing order and data.

The difference of color tone is not only the difference of color but also include the difference of brightness or chroma or their combination.

The second invention enables printing by plural kinds of ink. It also, in addition to the merit of the first invention, enables to reduce number of parts, prevent enlargement of equipment scale and make the apparatus cheap because only one laser beam scanner means(11) can make multicolor tone printing.

It is also enables in the second invention to use the mono color tone instead of multicolor tone, then enables to make printing in high speed and efficiently.

Embodiment No.3

The third invention is shown in FIG. 3. It has plural laser beam scanning means ($\mathbf{11}_1$~$\mathbf{11}_n$) which scan the laser beam originated from laser beam source, plural ink jet means ($\mathbf{13}_1$~$\mathbf{13}_n$), conveyor means(12) which transports the printing medium(14) and multicolor tone printing control means (21) which sends order to the conveyor means. The plural ink jet means($\mathbf{13}_1$~$\mathbf{13}_n$) hold ink or any printing material of multiple or one color tone adjutant to the surface of a printing medium(14) and along a direction transversely crossing the conveying direction of the printing medium (14), and jet the printing material which is irradiated by the laser beam scanned along the respective regions, toward the surface of the printing medium(14).

The third invention, on contrary to the second invention, has plural pairs of laser beam scanner means and ink jet means and enables the multicolor tone printing. Owing to these plural means, it can control the scanning of laser beam simultaneously but individually to each color tone, it makes multicolor printing in very high speed. This is a special characteristics in addition to the merit of the first invention.

In the third invention, it is not limited to multicolor printing. By using the same color tone, printing can be made more rapidly and efficiently.

Embodiment No.4

The fourth invention has ink jet means, mentioned in the first, second and third inventions. And the ink jet means has a (or plural) ink holding body which holds the supplied ink in belt shaped region, and the ink holding body is placed in a container. There are openings on sides of the container along the belt shaped region, facing printing medium and laser beam scanning. The openings on laser scanning side are covered by a transparent board which enable the laser beam pass through the transparent board. The laser scanning side is usually the opposite to the side facing printing medium but not always.

As the fourth invention has a container which holds ink holding body and cover the laser scanner side with transparent boards, the ink is not disposed to outside, so it prevents evaporation or changing quality of ink to a minimum and make an efficient printing. This is the characteristic of the fourth invention in addition to the merits of first, second and third inventions.

Embodiment No.5

The fifth invention is about ink jet means, mentioned in the first, second, third or fourth invention. The ink jet means has ink holding body formed by porous structure material made of ceramics, metal or similar and holds the supplied ink in the said region. Thus, the fifth invention can realize simple construction, minimizing of parts number, miniaturization, lightening, and low cost in addition to the merit played by from the first to the fourth inventions.

Embodiment No.6

The sixth invention is about the ink jet means, mentioned in the fifth invention, which has ink tank and ink supply route for ink from the ink tank to the ink jet means infiltrating continuously.

The sixth invention has merits of enduring for long time printing and keeping quality of printing, in addition to the merit of the fifth invention, because of simple construction and supply system of ink continuously long time.

Embodiment No.7

The seventh invention is about the transparent board, mentioned in the fourth, fifth and sixth inventions. The transparent board is made of single or multi layer which is practically one fourth wave length thick. The reason of using "practically one forth wave length single or multi layer film" is to prevent reflection of laser beam and to penetrate laser beam efficiently.

The seventh invention has merits, in addition to the effects of the fourth, fifth and sixth inventions, of saving consumed energy and diminish running cost by preventing reflection of laser beam and by penetrating laser beam efficiently.

Embodiment No.8

The eighth invention is about laser beam scanning means, mentioned in from the first invention to the seventh invention, which have beam direction converter and light guide means. The beam direction converter changes direction of laser beam issued from the laser beam source by rotating at the designated angle velocity. The light guide means is made of plural light guides of which input terminals are arranged at the place where the direction converted laser beam passes, and the output terminals are arranged along the region where ink of ink jet means is hold.

The designated angle velocity of the beam direction converter is usually a fixed angle velocity. But in order to maintain the constant velocity of scanning of laser beam at the said ink jet means, it is unnecessary to be a fixed angle velocity.

The eighth invention is able to scan laser beam without using complicated optical system, in addition to the effects played by the other inventions.

Embodiment No.9

The ninth invention is about beam direction converter means and light guide means mentioned in the eight invention. The beam direction converter means converts the direction of laser beam issued from the laser source. It has a rotatable mirror fixed at the designated tilt angle on the rotation axis consistent to the light axis of the laser beam source, and a motor to rotate the said mirror. A focusing lens will be used if necessary.

The light guide means irradiates laser beam in order to the area where ink is hold through plural optical fibers which the one ends are arranged to the places on which the laser beam converted by the said beam direction converter passes and the other ends are arranged to the region where the ink is hold by the said ink jet means. The designated tilt angle is usually 45 degrees.

The ninth invention is able to scan the laser beam surely with simple construction and simple movement by using a mirror and optical fibers, in addition to the effect played by the eighth invention.

Embodiment No.10

The tenth invention is about the light guide means of laser beam scanning means, mentioned in the ninth invention. The light guide means is made of one piece of transparent body which refraction rate is "n" involving in it plural transparent pillar shaped body which refraction rate is "m" (m>n). In addition to the effects played by the ninth invention, the tenth invention is able to transfer the laser beam efficiently using total reflection. And it is easier to manufacture than to use optical fibers and rigidity is reinforced.

1, $11_1$~$11_n$. . . Laser beam scanning means.

2, 12 . . . Conveyor means.

3, 13, $13_1$~$13_n$, $23_1$~$23_n$. . . Inkjet means.

4, 14 . . . Printing medium.

5, 15 . . . Printing control means.

6 . . . Laser beam source.

7 . . . Beam direction converter

8 . . . Light guide board.

9 . . . Ink tank

16 . . . Selective movement means.

20, 21 . . . Multicolor printing control means.

31 . . . Ink maintenance body.

32 . . . Transparent film.

33 . . . Light guide.

DETAILED DESCRIPTION OF PREFERRED EMBODIMENT OF THE INVENTION

The First Example of this Invention

The first example of the invention of this invention is explained with from FIGS. 4 to 8.

Figure 1:
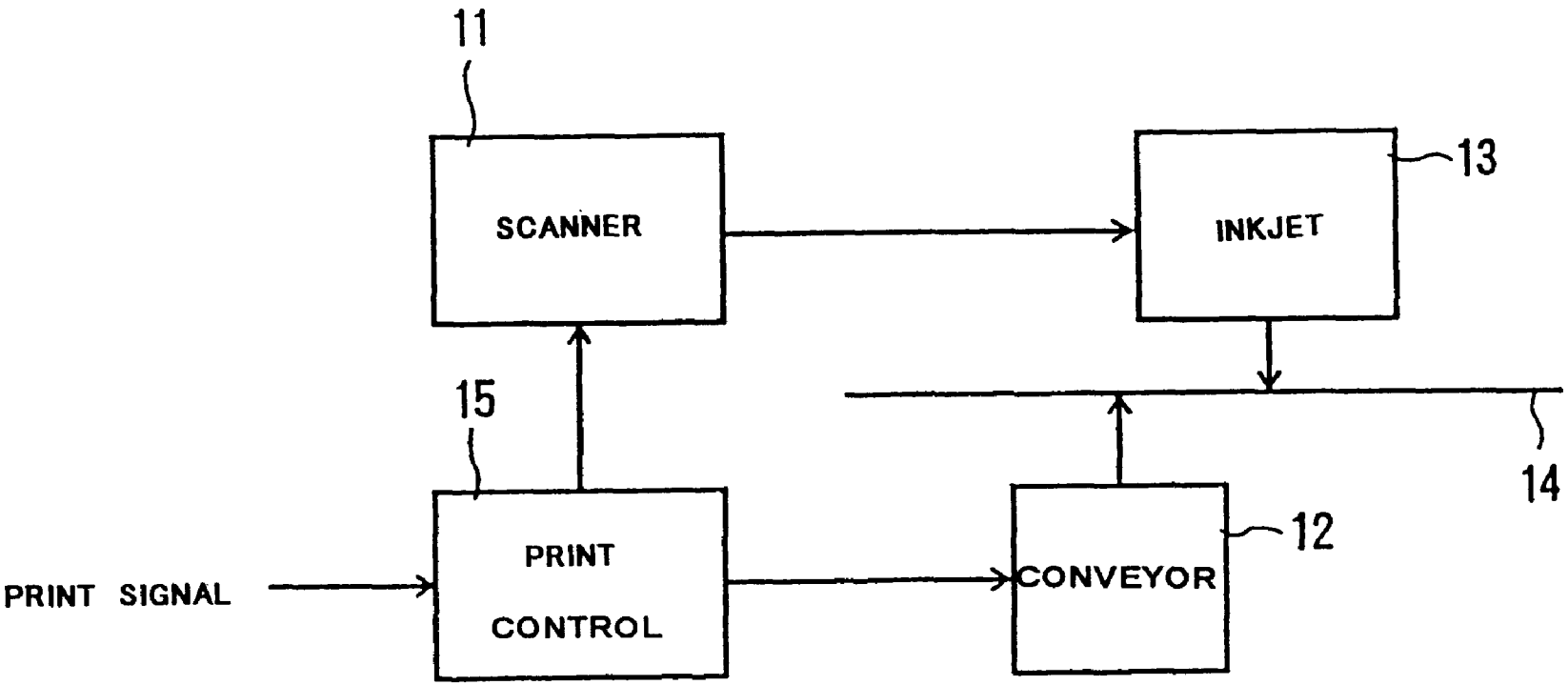
FIG. 1 is a principle block diagram of the first invention.
Figure 2:
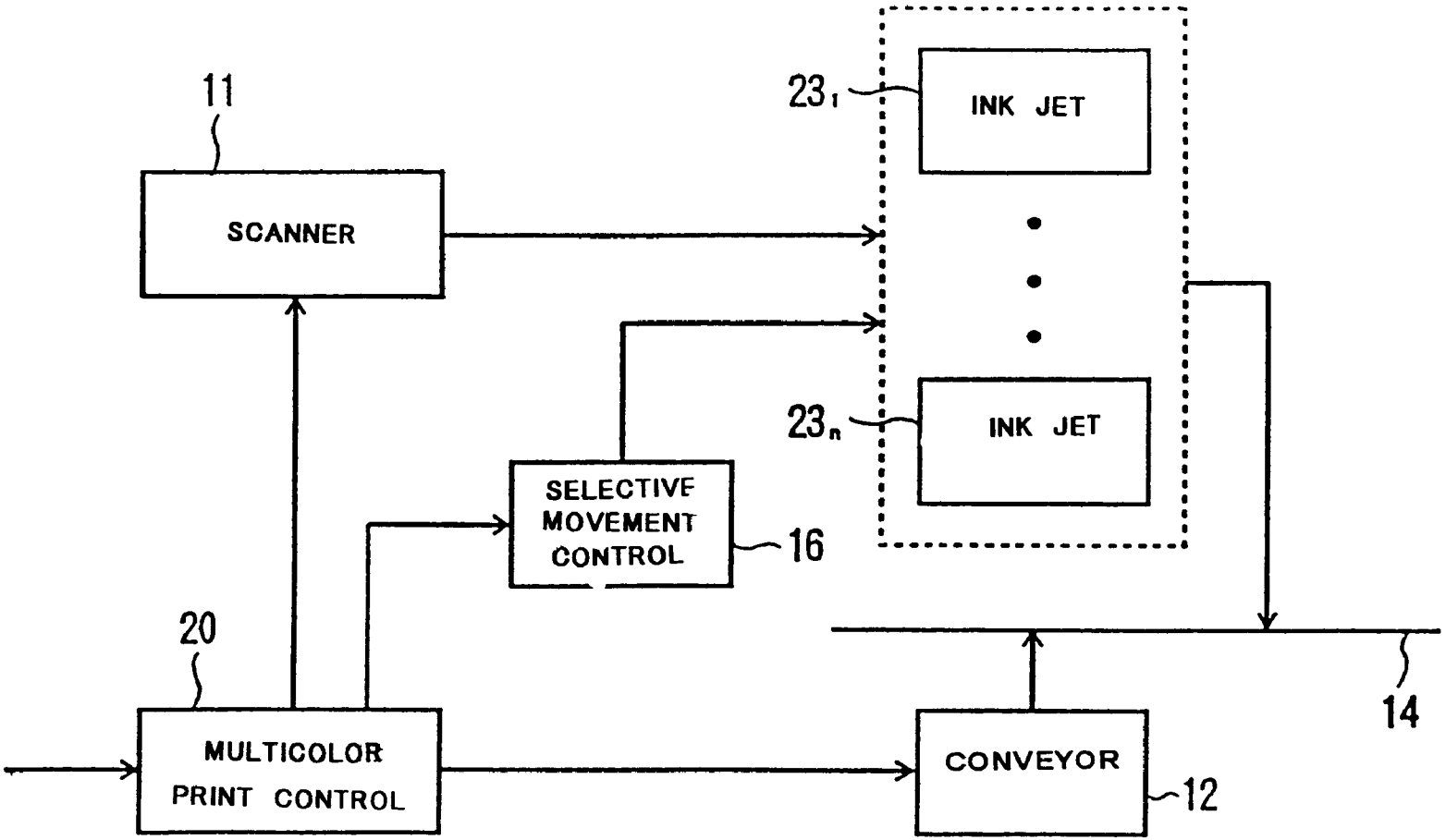
FIG. 2 is a principle block diagram of the second invention.
Figure 3:
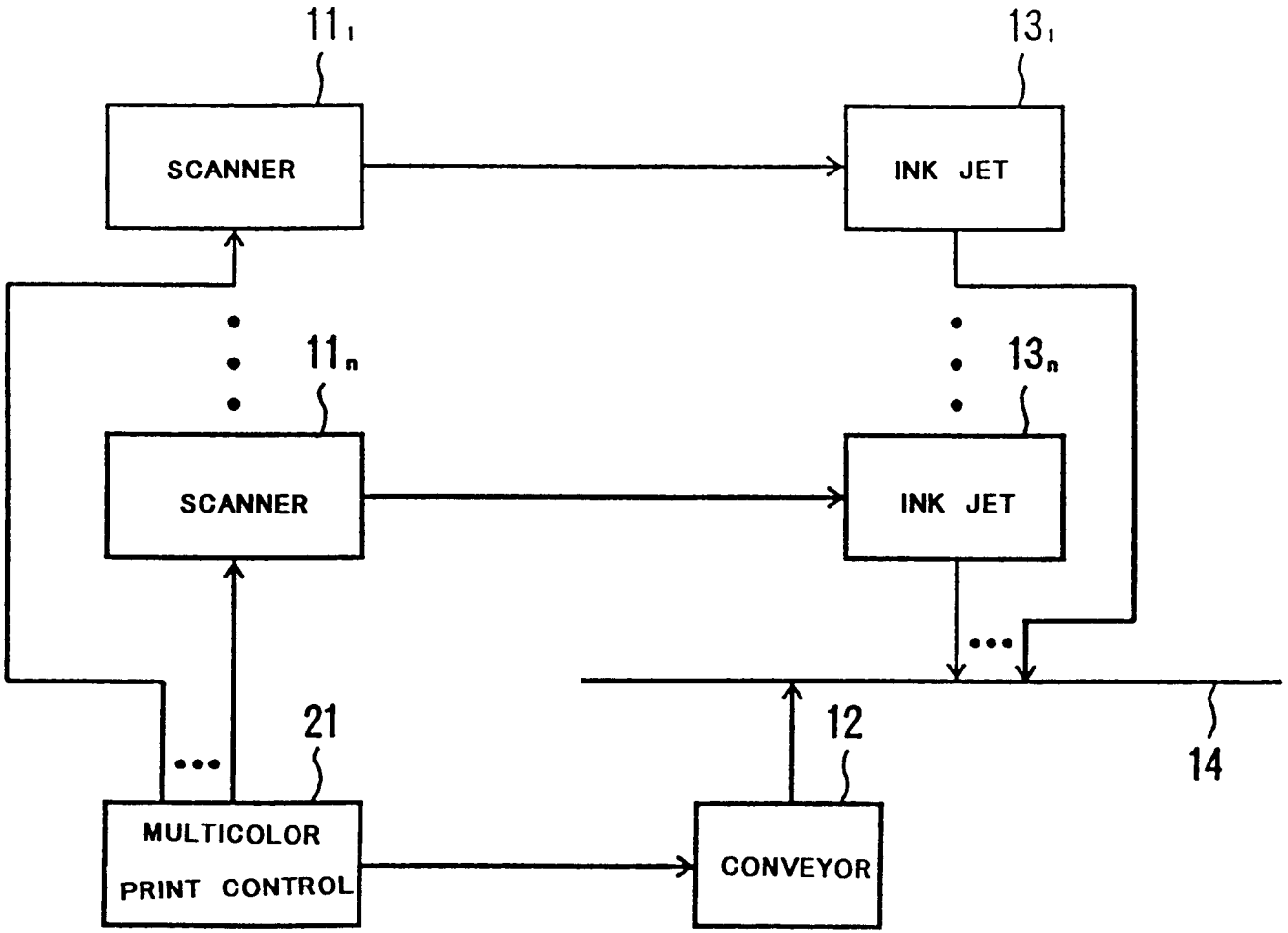
FIG. 3 is a principle block diagram of the third invention.
Figure 4:
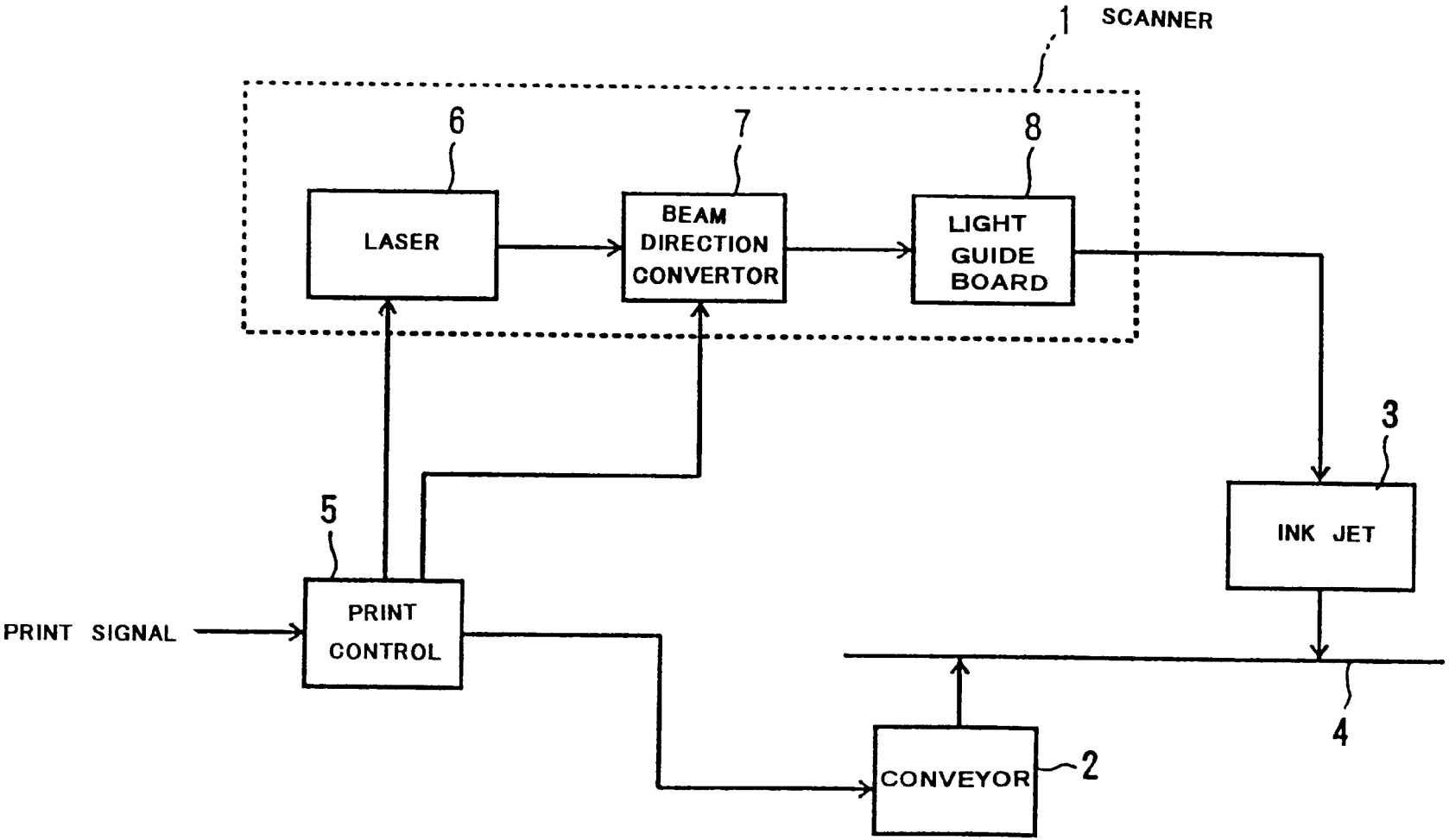
FIG. 4 is a block diagram of the printing system related to the first example of the invention.
Figure 5:
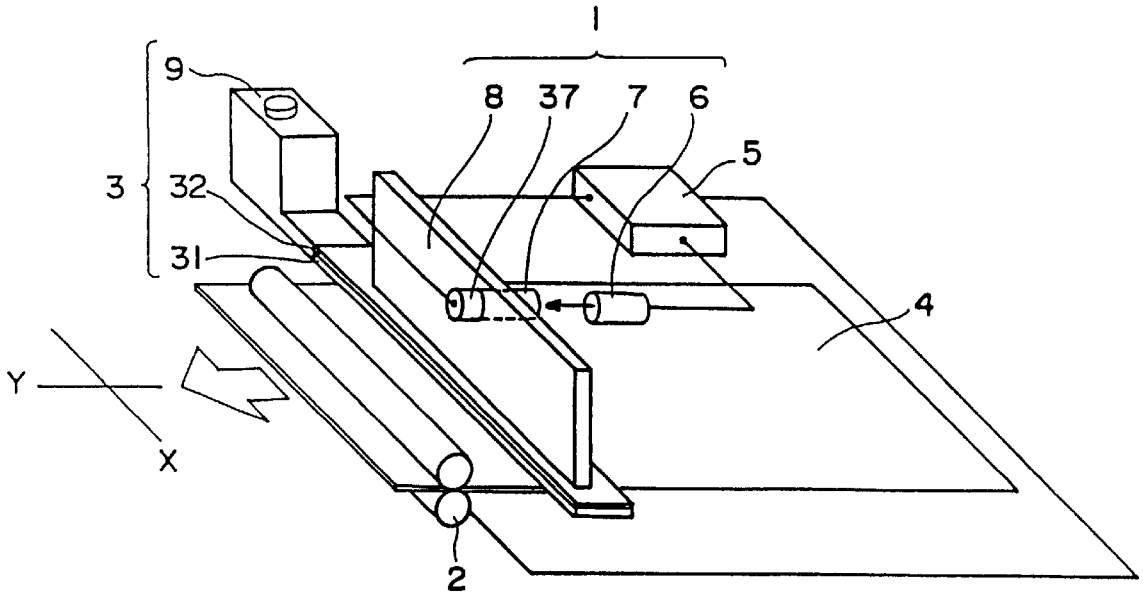
FIG. 5 is an outline squint drawing of the printing system related to the first example of the invention.

FIG. 4 is a block diagram of the whole printing system related to the first example of the invention and FIG. 5 is an outline squint drawing of the printing system.

This example of the invention posses laser scanner means (1), ink jet means(3), conveyor means(2) and print control means(5). The laser scanner means(1) is to scan laser beam originated laser beam source(6). The ink jet means (3) approaches to printing medium like paper(4) and holds ink at the region along direction which crossed at the right angle (direction X in FIG. 5) with direction of conveying printing medium (direction Y in FIG. 5). The conveyor means(2) transport printing medium(4). The print control means(S) is composed with CPU and memories to control the laser beam scanning means(1) and the conveyor means(4).

As shown in FIGS. 4 and 5, the laser beam scanning means(1) posses laser beam source(6) such as semiconductor laser, beam direction converter(7) which convert the direction of laser beam originated from laser beam source by rotating at the designated angle velocity, and light guide board(8).

Figure 6:
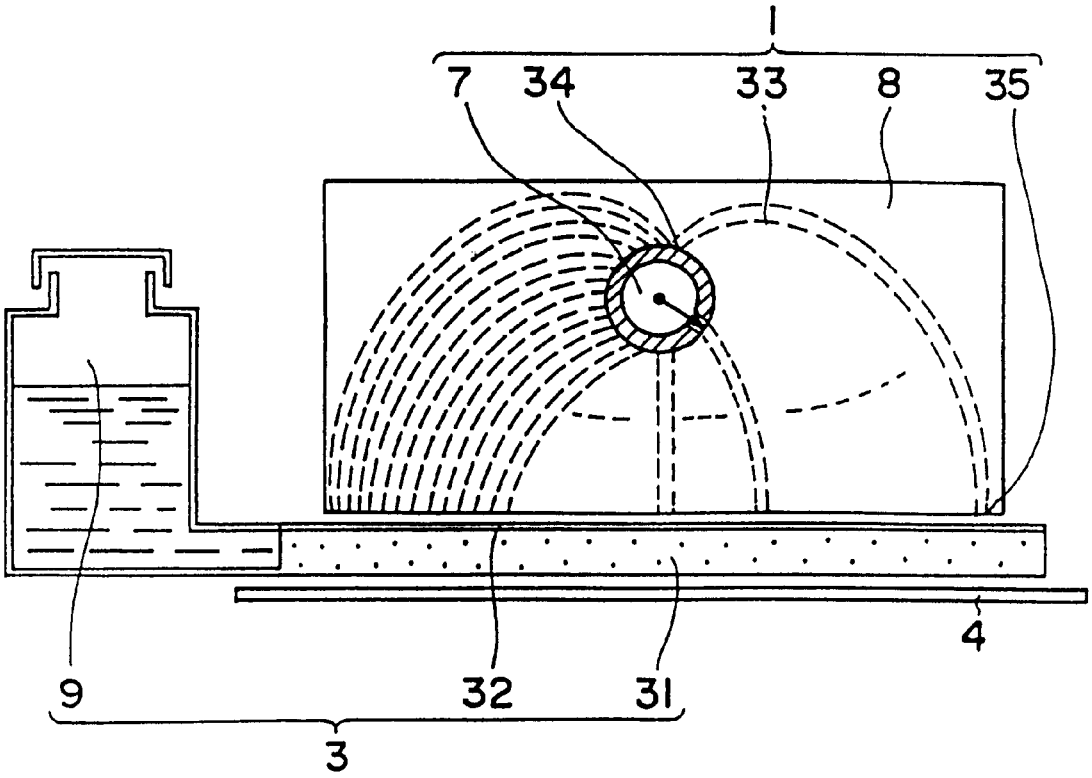
FIG. 6 is a drawing to show the principal part of the printing system related to the first example of the invention.

FIG. 6 shows the principal part of the printing system related to the first example of the invention. As shown in FIG. 6 or 5, the ink jet means(3) is consist of ink tank(9) which contains ink and a thin belt shaped ink maintenance body(31) which maintain the supplied ink along X direction.

On the upper part of the ink maintenance body, a transparent film(32) is put and through it the laser beam of the laser scanning means(1) is irradiated.

It is preferable that the transparent film(32) is a single or multi layer film with thickness of practically one fourth wave length of laser beam radiated, so it prevents reflection of laser beam and to penetrate most of laser beam efficiently.

Figure 7:
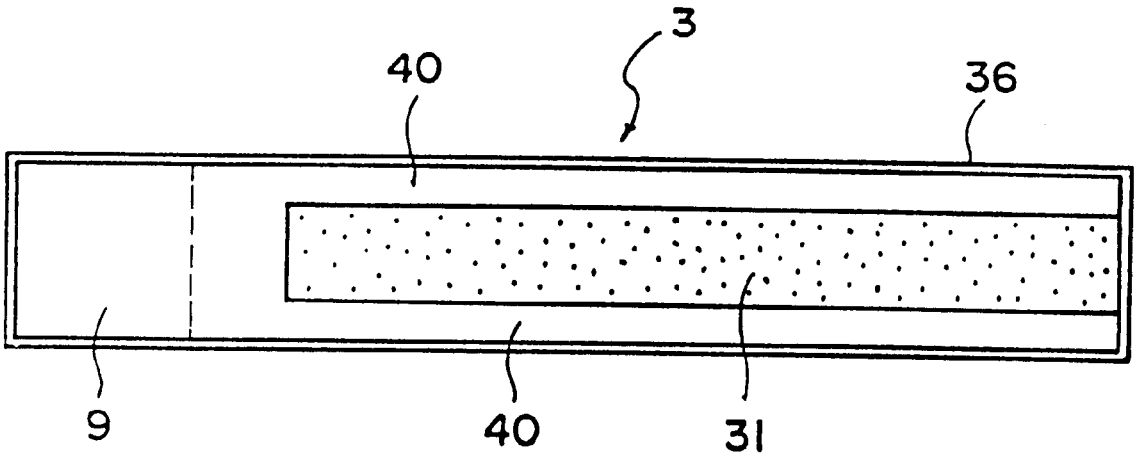
FIG. 7 is a drawing to show the ink jet means related to the first example of the invention.
Figure 8A:
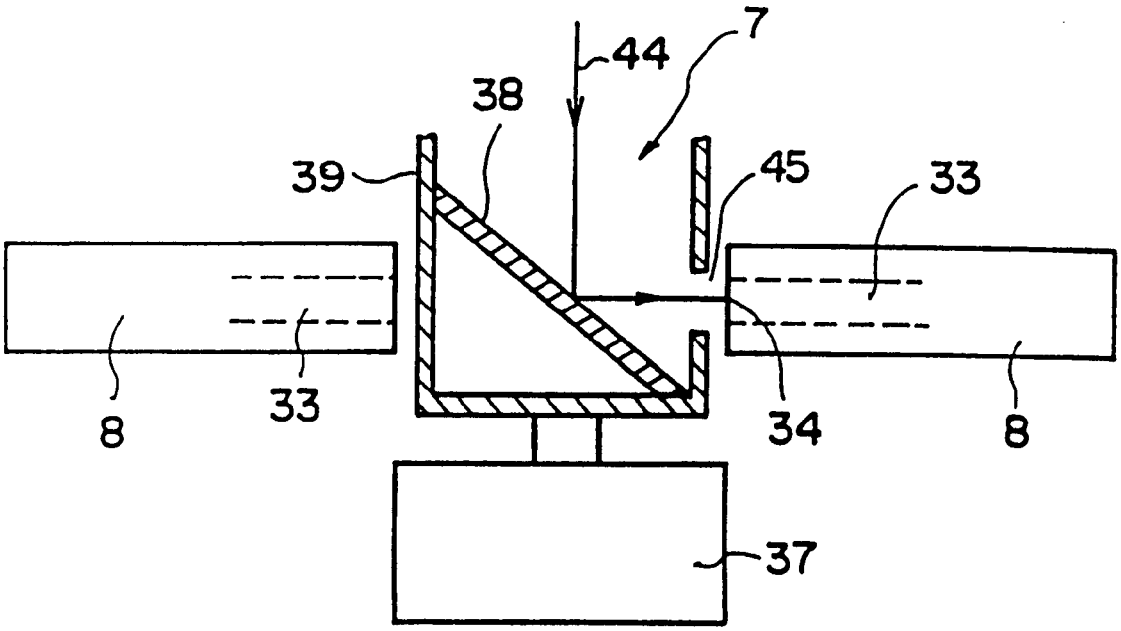
FIGS. 8(*a*) and 8(*b*) are a drawing of the laser beam direction converter and the ink jet means FIGS. 9(*a*) and 9(*b*) are an outline drawing related the second and the third example of the invention.
Figure 8B:
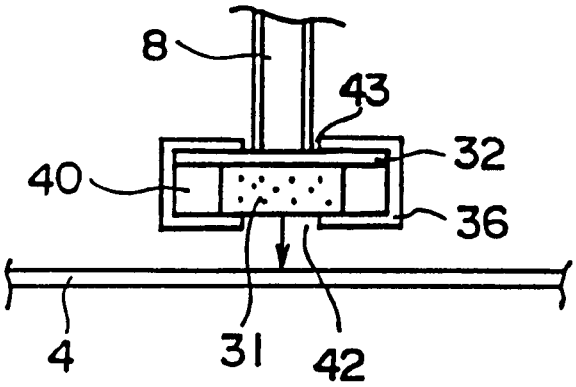

FIGS. 7 and 8(*b*) show another example of the ink jet means(3) which holds the said ink maintenance body(31) and transparent film(32) inside a container(36).

The container(36) has openings(42 & 43) along the said region, on lower side which faces printing medium and on upper side where laser beam scans. On the back side of the ink maintenance body(31) which is the laser scanning side and where radiated laser beam penetrate inside, there is a transparent film(32) which closes opening(43) and prohibit the ink goes out or in.

In this example, as the ink maintenance body(31) are installed inside the container(36), evaporation or change of ink quality can be suppressed in minimum.

Also, FIGS. 7 and 8(*b*) shows that the said container(36) has ink supply route(40) on both side of ink maintenance body(31). The ink supply route(40) guides ink from the ink tank(9) and infiltrates ink continuously into the ink maintenance body(31).

The ink maintenance body(31) is made of porous structure of ceramic, metal or other material and keeps ink in such minute holes of the material.

FIGS. 6 and 8(*a*) show the laser beam direction converter (7) and the light guide board(8) of the said laser beam scanning means(1).

The laser beam direction converter(7) has a rotatable mirror(38) which is installed at tilt angle of 45 degree for a rotation axis matched to optic axis of laser beam source(6), and a motor(37) which rotates the mirror(38). The mirror (38) is installed inside a cylinder body(39) matched to the rotating axis of the motor(37). The cylinder body(39) has an opening for the direction of laser beam source(6) and a hole(45) on the side of its body through which the laser beam converted its direction at 90 degree by the mirror(38) is radiated to each light guides(33) in the light guide board(8). The light guide board(8) contains internally lots of light guide(33).

The light guide board(8) and the light guides(33) are formed with a transparent material against laser beam(44), and the refraction rate of the light guide(33) is set larger than that of the light guide board(8). Therefore, the laser beam (44) is transmitted inside the light guides(33) at low loss by perfect reflection.

As shown in FIGS. 6 and 8(*a*), the one edge of each light guide(33) is arranged to the position adjacent to the circumference where the hole(45) opened on the side of the cylinder body(39) passes by rotation and the laser beam converted by the laser beam converter(7) can pass on it. The other edge of the light guide(33) is arranged to along the opening(43) of the container(36) of the ink jet means(3), and irradiate the laser beam one by one to the ink maintenance body(31) according to rotation of the mirror(38) of the laser beam direction converter(7).

Hereafter, the operation of the first example of this invention is explained:

By the instruction from the print control means(5) the laser beam source(6) is controlled, then the laser beam is switched on/off or the amount of the light volume according to the settled strength of laser beam and the printing data for printing. According to the instruction, the laser beam(44) comes out from the laser beam source(6) and comes into the laser beam direction converter(7) which is rotated by the motor(37). Then the laser beam(44) is reflected by the mirror(38) installed in the cylinder body(39) of the laser beam direction converter(7), converted the direction 90 degree and goes into the entrance edge(34) of the light guide through the hole(45) of the cylinder body(39), pass through the light guide(33) of the light guide board(8) and ejected out from the ejecting edge(35) of the light guide.

The laser beam invades inside the ink maintenance body (31) through the opening(43) of the container(36) and the transparent film(32). Then, it expands, by energy of the laser beam, the ink held in minute holes of the ink maintenance body(31) and gushes the ink towards the printing media(4) through the opening(42) of the container(36). The gushed ink adheres to the surface of the printing medium(4) and the printing is made.

When the printing of one line in the direction of X is finished by the method stated above, the printing medium is transported by the designated distance in the direction of Y by the roller of the conveyor means(2) by the instruction of the printing control means(5), and the following printing is executed one by one.

In this example as the ink maintenance body(31) is formed to the thin type, energy of the laser beam irradiated on the back side of the ink maintenance body(31) which faces printing medium(4) can efficiently be transferred to the ink.

Summary of characteristic of the first example of this invention are:

1) It has thin, porous type ink maintenance body and the ink maintenance body is supplied ink continuously from ink tank.

2) It has a transparent film on the back of the ink maintenance body, and the film is transparent to the laser beam but not pass by ink.

3) Laser beam that controlled irradiation position and strength according to data of printing is irradiated on the transparent film.

4) Ink in the position where laser beam is irradiated is jet by expanding or evaporating, and printing is made by adhering of ink to the printing medium like paper adjacent to the ink maintenance body.

5) By synchronizing the transportation of paper with progress situation of printing, a continuous printing becomes possible.

The Second Example of this Invention

Figure 9A:
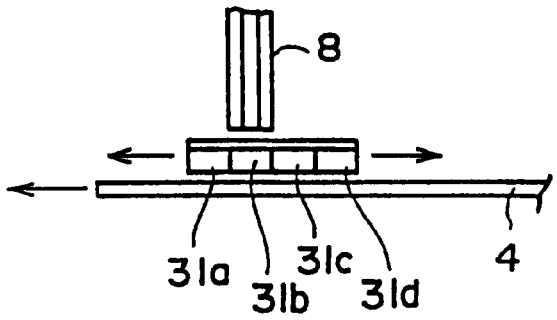
Figure 9B:
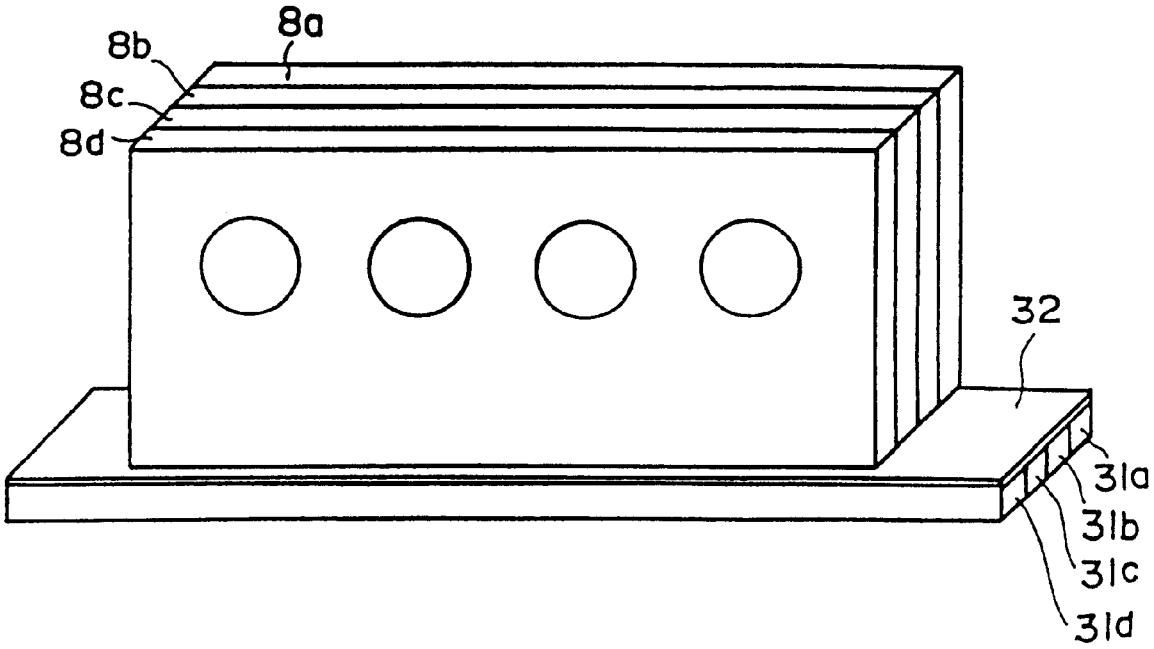
Figure 10:
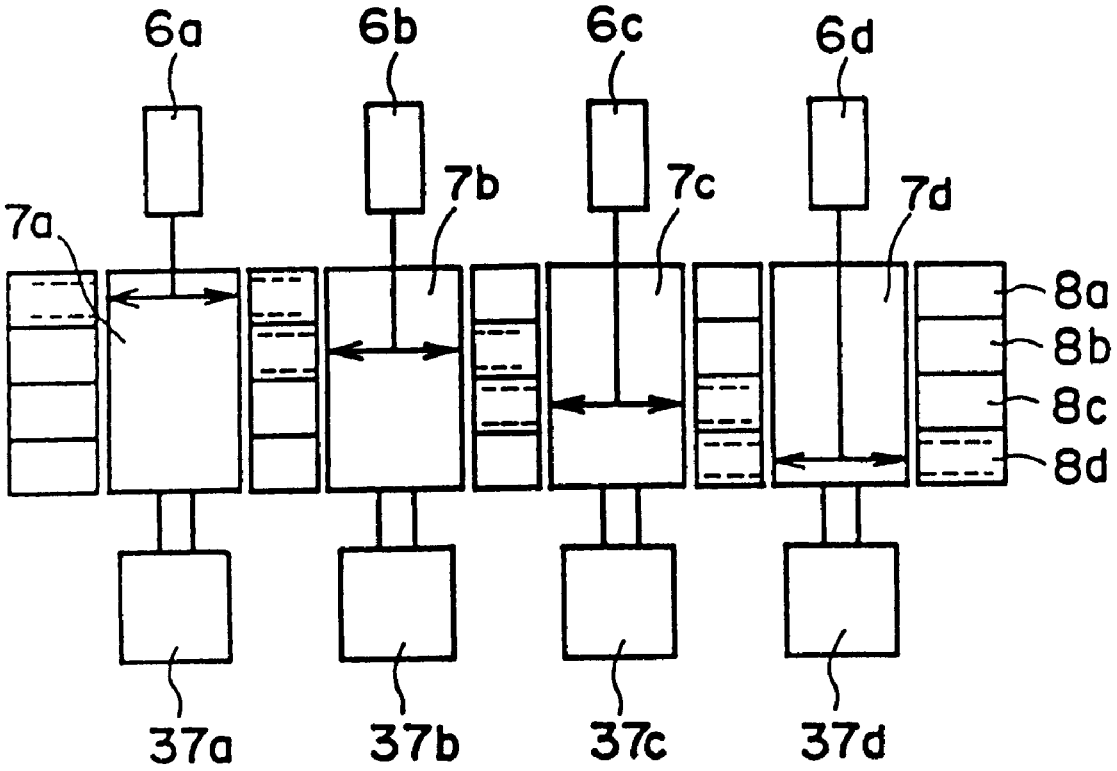
FIG. 10 is a drawing to explain the light guide board related to the third example of the invention.

The second example of the invention is explained by FIG. 9(*a*) which is a partial explanation figure of the printing system of the second example. In the second example, unlike the first example, the ink maintenance body(31) is split into plural bodies(31*a*, 31*b*, 31*c*, 31*d*) and different color ink is impregnated in each body. The ink maintenance bodies (31*a*, 31*b*, 31*c*, 31*d*) can be moved in the direction Y by the selective conveyor means which is not shown in the figure.

When printing, the selected ink maintenance body (in the FIG. 9) out of bodies(31*a*, 31*b*, 31*c*, 31*d*)is moved rightly under the light guide board(8) and the laser beam transmitted through the light guide board(8) is irradiated. Then, multicolor printing can be made. For example, using red, green, blue and black ink in four each ink maintenance bodies, a color printing can be made.

In this example of the invention, not only color printing but a high speed monochrome printing can be made by holding same color ink in all ink maintenance bodies.

In FIG. 9(*b*), plural ink maintenance bodies are set. It is also advisable to install plural containers each of which holds each ink maintenance body respectively.

The Third Example of this Invention

The third example of this invention is explained by FIGS. 9(*b*) and 10 which are partial explanation figures of the printing system of the third example. As the said laser scanning means, laser beam sources(6*a*, 6*b*, 6*c*, 6*d*), laser beam direction converters(7*a*, 7*b*, 7*c*, 7*d*), motors(37*a*, 37*b*, 37*c*, 37*d*) and light guide board(8*a*, 8*b*, 8*c*, 8*d*) are installed.

In this example, unlike to the second example, instead of one laser beam scanning means plural laser scanning means which are same numbers to the ink jet means corresponding to each ink jet means, so that it is not necessary to move the ink maintenance body for printing but to make simultaneously printing of each ink in high speed and in multicolor. If the same color ink is used in each ink maintenance body, faster printing can be made for monochrome printing.

In the above mentioned examples of this invention, laser beam scanning means is using optical fiber or light guide for scanning laser beam, but it is also advisable to use polygon mirror and lens for scanning.

Possibility of Use in Industrial Field

The image formation apparatus made by this invention can be used not only for printing system but also for information process machine like personnel computer and word processor, facsimile and copying machine.

Having thus described the invention, what is claimed is:

1. An image formation apparatus comprises, a laser scanning means (11), an ink jet means (13), a conveyor means (12) and a multicolor printing control means (10), wherein the laser beam scanning means (11) scans laser beam originated from a laser beam source, the ink jet means (13) installed adjacent to the face of printing medium in direction transverse to direction of conveying printing medium, and holds ink maintenance body made of porous structure material having a plurality of pores arranged so as to be capable of absorbing the ink such as ceramics or metal, and gushes the ink which is irradiated by the scanned laser beam to the face of printing medium, the conveyor means (12) transports printing medium, and the print control means (10) controls said laser scanning means (11) and the conveyor means (12) according to the instruction of printing and data for printing, wherein the beam scanning means consists of a direction converter means and a light guide means, wherein the direction converter means comprises a rotatable mirror installed at the designated tilt angle at a rotation axis matched to the optic axis of the laser beam source, inside a cylinder body having an opening for the direction of the laser beam source and a hole on the side of its body through which the laser beam converted on its direction is radiated to each light guide and a motor to rotate said mirror installed inside the cylinder body matched to a rotating axis thereof and changes the direction of the laser beam originated from the laser beam source at a designated angle speed, and the light guide means with plural light guides provides intake edges arranged alongside the position adjacent to the circumference where the hole opened on the side of the cylinder body passes by rotation and outgoing edges arranged alongside the region where the ink of ink jet means are held.

2. An image formation apparatus comprises a laser beam scanning means (11), plural ink jet means ($\mathbf{23}_1$–$\mathbf{23}_n$), selective moving means (16), conveyor means (12) and multicolor printing control means (20), wherein the laser beam scanning means (11) scans laser beam originated from a laser beam source, the plural ink jet means ($\mathbf{23}_1$–$\mathbf{23}_n$) holds different or same color printing material such as ink in each ink maintenance body made of porous structure materials having a plurality of pores arranged so as to be capable of absorbing the ink like ceramics or metal installed adjacent to a face of printing medium(14) along in transverse direction to conveyor direction of the printing medium, and gush the corresponding printing material to the face of printing medium when it is moved to the position where laser beam is irradiated by the laser beam scanning means(11), the selective moving means (16) moves the selected ink jet means among the plural ink jet means ($\mathbf{23}_1$–$\mathbf{23}_n$) to the position where the scanned laser beam is irradiated by the laser beam scanning means(11), the conveyor means (12) transports the printing medium, and the multicolor printing control means (20) controls the laser beam scanning means (11), the selective moving means (16) and the conveyor means (12) according to the instruction of printing and the data of printing, wherein the beam scanning means consists of a direction converter means and a light guide means, wherein the direction converter means comprises a rotatable mirror installed at the designated tilt angle at a rotation axis matched to the optic axis of the laser beam source, inside a cylinder body having an opening for the direction of the laser beam source and a hole on the side of its body through which the laser beam converted on its direction is radiated to each light guide and a motor to rotate said mirror installed inside the cylinder body matched to a rotating axis thereof and changes the direction of the laser beam originated from the laser beam source at a designated angle speed, and the light guide means with plural light guides provides intake edges arranged alongside the position adjacent to the circumference where the hole opened on the side of the cylinder body passes by rotation and outgoing edges arranged alongside the region where the ink of ink jet means are held.

3. An image formation apparatus comprises laser beam scanning means ($11_1$–$11_n$), plural ink jet means ($13_1$–$13_n$), conveyor means (12) and multicolor printing control means (21), wherein the laser beam scanning means ($11_1$–$11_n$) scans laser beam originated from a laser beam source, the plural ink jet means ($13_1$–$13_n$) holds different or same color printing material such as ink in each ink maintenance body made of porous structure materials having a plurality of pores arranged so as to be capable of absorbing the ink like ceramics or metal installed adjacent to a face of printing medium(14) along in transverse direction to conveyor direction of the printing medium and gush the corresponding printing material to the face of printing medium when it is moved to the position where laser beam is irradiated by the laser beam scanning means(11), wherein the conveyor means (12) transports the printing medium, and the multicolor printing control means (21) controls the laser beam scanning means($11_1$–$11_n$) and the conveyor means(12) according to the instruction of printing and the data of printing, wherein the beam scanning means consists of a direction converter means and a light guide means, wherein the direction converter means comprises a rotatable mirror installed at the designated tilt angle at a rotation axis matched to the optic axis of the laser beam source, inside a cylinder body having an opening for the direction of the laser beam source and a hole on the side of its body through which the laser beam converted on its direction is radiated to each light guide and a motor to rotate said mirror installed inside the cylinder body matched to a rotating axis thereof and changes the direction of the laser beam originated from the laser beam source at a designated angle speed, and the light guide means with plural light guides provides intake edges arranged alongside the position adjacent to the circumference where the hole opened on the side of the cylinder body passes by rotation and outgoing edges arranged alongside the region where the ink of ink jet means are held.

4. An image formation apparatus described in the claim 1, 2 or 3 provides ink jet means consists of ink maintenance body, container and openings, wherein the ink maintenance body is long square type like belt made of porous material having a plurality of pores arranged so as to be capable of absorbing the ink like ceramics or metal and holds supplied printing material like ink, the container holds the ink maintenance body inside and has openings along the ink maintenance body on printing medium side and on laser scanning side, and the opening of laser scanning side is covered by a transparent board which penetrates the laser beam inside.

5. An image formation apparatus described in the claim 4 provides ink jet means consists of ink maintenance body to hold ink and ink supply guide which supply ink from the ink tank to the ink maintenance body in continuous impregnation.

6. An image formation apparatus described in the claim 4 provides a transparent board made of single or multi layer film each of which is effectively equal to one fourth wave length of laser beam.

7. An image formation apparatus described in the claim 1, 2, or 3, wherein the light guide means consists of plural optical fibers whose edges of the one side are arranged alongside to the position, where the laser beam converted by said beam direction convert means is able to pass, and the other side of the optical fibers are arranged alongside to the position where ink of the ink jet means are held to enable the laser beam irradiate to the region where the ink is held one by one.

8. An image formation apparatus described in the claim 7 provides a light guide means of laser beam scanning means, which is one piece of transparent board of refraction rate n enclosing internally lots of transparent pillar shaped material of refraction rate m, but refraction rate is m>n.

* * * * *